United States Patent [19]

Rajakallio

[11] Patent Number: 4,972,911

[45] Date of Patent: Nov. 27, 1990

[54] TRAVELLING CENTRALIZER ARRANGEMENT IN A ROCK DRILL

[75] Inventor: Pauli Rajakallio, Siivikkala, Finland

[73] Assignee: Oy Tampella AB, Tampere, Finland

[21] Appl. No.: 484,400

[22] Filed: Feb. 23, 1990

[30] Foreign Application Priority Data

Mar. 8, 1989 [FI] Finland ..... 891102

[51] Int. Cl.[5] ..... E21B 19/08; E21C 9/00

[52] U.S. Cl. ..... 175/220; 166/85; 175/203

[58] Field of Search ..... 175/220, 113, 121, 122, 175/162, 203; 414/22.58, 22.61, 22.68; 173/45; 166/85, 77.5, 241

[56] References Cited

U.S. PATENT DOCUMENTS

| | | | |
|---|---|---|---|
| 3,795,326 | 3/1974 | Neilon et al. | 414/22.58 |
| 4,834,195 | 5/1989 | Robinson | 166/85 |

FOREIGN PATENT DOCUMENTS

| | | | |
|---|---|---|---|
| 1130530 | 8/1982 | Canada | 175/220 |
| 955651 | 4/1964 | United Kingdom | 175/220 |
| 960579 | 6/1964 | United Kingdom | 175/220 |
| 1149478 | 4/1969 | United Kingdom | 175/220 |

*Primary Examiner*—Stephen J. Novosad
*Attorney, Agent, or Firm*—Ladas & Parry

[57] ABSTRACT

The invention relates to a travelling centralizer arrangement in a rock drill (2), comprising a travelling centralizer (5) movable along the feeding beam (1) during the drilling. The travelling centralizer (5) of the arrangement comprises two jaw halves (**12*a*, 12*b*) mounted in a carriage (8) provided for the travelling centralizer so as to be pivoted about journals (13*a*, 13*b*) parallel to the feeding beam (1). Each jaw half (12*a*, 12*b*) comprises a wheel (9*a*, 9*b*) moving along the guideways (10) of the feeding beam (1) and keeping the jaw halves (12, 12*b*) pressed against each other during normal drilling so that jaws (14*a*, 14*b*) form a drill rod centralizer concentric with the drill rod (4). The guideways (10) comprises at the forward end of the feeding beam (1) a portion (L) which extends downward from the straight guideway portion. When the travelling centralizer reaches this downwardly extending guideway portion, the wheels (9*a*, 9*b*) are displaced downward along the surface of the guideways, so that the jaw halves (12*a*, 12*b*) are pivoted about the journals (13*a*, 13*b*), thus drawing the jaws (14*a*, 14*b*) of the travelling centralizer apart from each other so that the chuck (3**) is able to pass therethrough.

9 Claims, 1 Drawing Sheet

FIG. 1
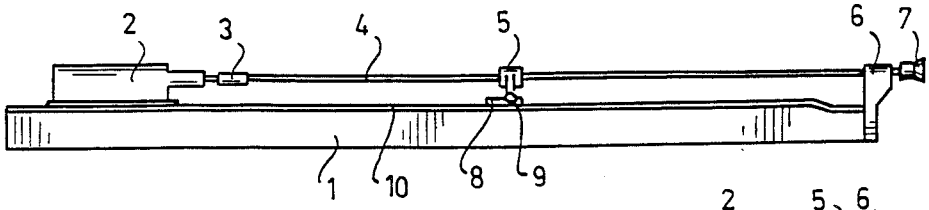
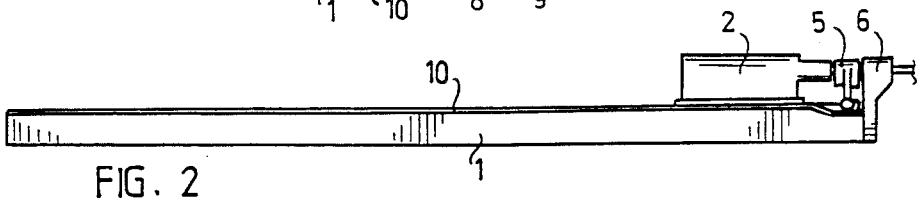
FIG. 2
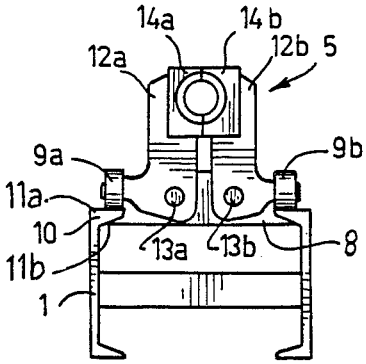
FIG. 3
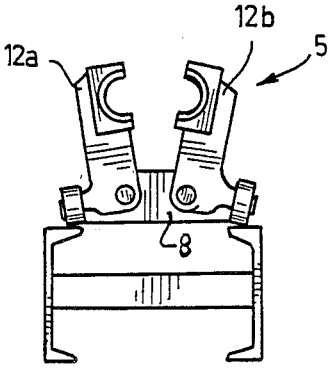
FIG. 4
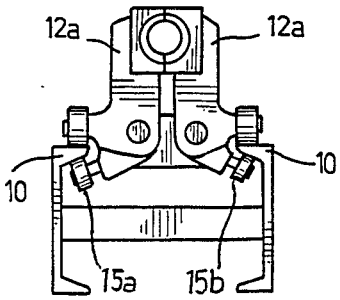
FIG. 5
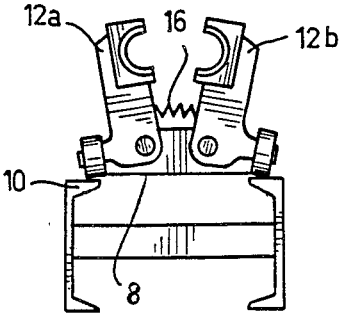
FIG. 6

TRAVELLING CENTRALIZER ARRANGEMENT IN A ROCK DRILL

The invention relates to a travelling centralizer arrangement in a rock drill, comprising a travelling centralizer mounted so as to move along a feeding beam in its longitudinal direction for supporting a drill rod, the travelling centralizer comprising two jaw halves arranged to be pressed against each other in the operating position of the centralizer and allowing the passage of a chuck between them when turned apart from each other; and guide means for pressing the jaw halves against each other.

Rock drills comprise a travelling centralizer for the support of the drill rod between the drifter and the drill steel centralizers disposed at the end of the feeding beam. The purpose of the travelling centralizer is to prevent the drill rod from bending aside from the drilling centre to avoid damage to the drill rod. The travelling centralizer is either connected to move at a rate half of that of the drifter so as to keep it all the time midway between the drifter and the front centralizers. Alternatively, the travelling centralizer stays in place until the drifter or the chuck strikes it, thus displacing it to the end of the feeding beam in proportion as the drilling proceeds. At this stage the drill steel centralizer is moved aside by the operator or by an automatic drilling mechanism to give way to the chuck so as to maximize the length of the hole to be drilled.

For instance, the travelling centralizer can be displaced aside by using a hydraulic or pneumatic swing mechanism which swings the travelling centralizer wholly aside from above the feeding beam. Furthermore, the travelling centralizer can be arranged to be pivoted about an axis transverse to the drill rod under the influence of the thrust of either the drifter or the chuck, so that a larger hole provided in the centralizer becomes visible and the chuck can be passed through the travelling centralizer.

A drawback of the drill steel centralizers of the prior art is that they comprise an unnecessary complicated mechanism which is liable to dirt and dust and thus causes problems during drilling. In addition, they may further comprise a complicated and unreasonably expensive control equipment which the operator has to attend to and operate.

The object of the present invention is to provide a travelling centralizer arrangement which is simple and reliable in operation and which does not comprise any complicated constructions and which does not require any measures taken by the operator. This is achieved according to the invention in that the jaw halves are mounted in a carriage movable relative to the feeding beam in its longitudinal direction on both sides of the drill rod in the transverse direction relative to the feeding beam, said jaws being pivotable relative to the carriage about a pivot axis extending longitudinally of the feeding beam, that the guide means comprise a guide provided in each jaw half at a distance from the pivot axis, and at least one elongated guide member attached to the feeding beam in its longitudinal direction, the guides being supported against the guide member in the operating position of the travelling centralizer to keep the jaw halves pressed against each other; and that the guide member is so shaped at the forward end of the feeding beam that the guides are displaceable in the transverse direction of the guide member, allowing the jaw halves to be pivoted about the pivot axes apart from each other.

The basic idea of the invention is that the feeding beam does not only serve as a means guiding the movement of the drifter and the travelling centralizer but also as a means guiding the opening of the travelling centralizer. Separate guide means can be provided or the guideways of the feeding beam can be used for the guiding purposes. An advantage of the solution of the invention is that it is simple and easy to carry out as well as extremely reliable in operation. Furthermore, the two halves of the centralizer can be symmetrical or identical, so that the number of spare parts possibly needed can be minimized. In particular, if the opening movement is positively controlled, the travelling centralizer arrangement is operable in all possible positions without operational disturbances and separate guide equipment.

The invention will be described in greater detail in the attached drawings, wherein FIG. 1 is a schematic side view of a travelling centralizer arrangement according to the invention at the initial stage of the drilling process;

FIG. 2 shows the travelling centralizer arrangement of the invention in the open position of the travelling centralizer at the final stage of the drilling;

FIG. 3 shows the travelling centralizer arrangement of the invention at the operational stage of FIG. 1 as seen in the direction of the axis of the drill rod;

FIG. 4 shows the travelling centralizer arrangement of FIG. 3 at the operational stage of FIG. 2 as seen in the direction of the axis of the drill rod;

FIG. 5 shows another embodiment of the travelling centralizer arrangement of the invention; and FIG. 6 shows still another embodiment of the travelling centralizer of the invention.

In FIG. 1, a drifter 2 having a drill rod 4 attached to its forward end by a chuck 3 is arranged to move along a feeding beam 1. The drill rod 4 with a conventional drill bit 7 provided at its end moves through a travelling centralizer 5 and a front centralizer 6. FIG. 1 shows the initial stage of the drilling process, at which the drifter 2 is at the rear end of the feeding beam 1 and the travelling centralizer 5 substantially midway between the chuck 3 and the front centralizer 6. The travelling centralizer 5 moves along the feeding beam 1 on a carriage 8, in addition to which the centralizer comprises wheels 9 which roll along the upper surface 11*a* of the feeding beam on guideways 10 provided thereon. The feeding beam further comprises lower surfaces 11*b* the use of which will be described below in connection with FIG. 5. The guideways 10 of the feeding beam 1 are conventional straight guideways with the exception of a downward bend at the forward end a little before the front centralizer 6.

As shown in FIG. 3, the travelling centralizer 5 is mounted in a carriage 8 mounted slideably on the guideways 10. The travelling centralizer 5 comprises two jaw halves 12*a* and 12*b* which are mounted in the carriage 8 so as to be pivoted on journals 13*a* and 13*b* extending longitudinally of the feeding beam 1. Each jaw half 12*a* and 12*b* further comprises wheels 9*a* and 9*b* moving along the upper surface 11*a* of the guideways 10 on the feeding beam 1.

In FIG. 3, the travelling centralizer is positioned on the feeding beam 1 within the straight portion of the guideways 10 similarly as in FIG. 1, the upper surfaces 11*a* of the guideways 10 supporting the wheels 9*a* and 9*b*, thus keeping the jaw halves 12*a* and 12*b* of the travelling centralizer 5 pressed against each other. In FIG. 2, where the wheels 9 are positioned on the slanted portion of the guideways 10, that is, on a portion extending in a direction deviating from the longitudinal axis of the guideways, the travelling centralizer 5 is in a position shown in FIG. 4. In FIG. 4, the wheels 9*a* and 9*b* have moved downward along the guideways 10 with the result that while the carriage 8 remains at the same height with respect to the guideways 10, the jaw halves 12*a* and 12*b* of the travelling centralizer 5 are pivoted on the journals 13*a* and 13*b* and displaced apart from each other, thus opening wide apart on approaching the front centralizer 6. The chuck 3 is able to pass between the wide open jaw halves 12*a* and 12*b*, so that the travelling centralizer 5 will not prevent the drilling of a hole of a maximum length. When the drill rod is withdrawn from the hole, the travelling centralizer 5 is displaced backward and assumes its normal position with the jaws pressed against each other while it moves along the upper surfaces 11*a* of the guideways 10.

FIG. 5 shows a solution in which the opening of the jaws is controlled positively by providing additional wheels 15*a* and 15*b* below the guideways 10. These additional wheels are supported against the lower surfaces 11*b* of the guideways 10, and when the guideways turn downward, the wheels turn the jaw halves 12*a* and 12*b* apart from each other. In this solution, the guideway comprises two guide surfaces 11*a* and 11*b*, the upper guide surface 11*a* being positioned on the side of the jaw half so as to cause the wheel 9*a* to press the jaw half 12*a* against the other jaw half 12*b* when the travelling centralizer is positioned in the operating position. Correspondingly, the guide surface 11*b* on the opposite side of the guideway 10 faces away from the jaw half so that when the wheel 15*a* is supported against said guide surface 11*b* at the forward end of the feeding beam 1, it turns the jaw half 12*a* apart from the other jaw half 12*b*.

FIG. 6, in turn, shows a solution in which a spring 16 is mounted between the jaw halves 12*a* and 12*b* so as to force them apart from each other when the guideways turn downward.

The attached figures show a few embodiments of the invention, in some of which the opening of the travelling centralizer 5 is not positively controlled but takes place merely under the influence of the force of gravity acting on the jaw halves 12*a* and 12*b* when the feeding beam 1 is in the position shown in FIG. 2 if the jaws 14*a* and 14*b* of the jaw halves are suitably cone-shaped on the side of the chuck 3 so that the chuck 3 is inserted into the cone. The invention, however, can be applied in various ways, depending on the use. The opening of the centralizer can be controlled positively in various ways known per se. A spring can be mounted between the jaw halves as shown in FIG. 6, the spring tending to open the jaws of the travelling centralizer, which takes place when the guideway allows the wheels to turn downward. Instead of mounting the jaw halves each with a separate journal, it is possible to shape them so that a common journal or bolt or the like is positioned substantially centrally in the transverse direction of the feeding beam. Furthermore, the jaw halves can be so shaped that the wheel guiding the opening of the jaw is positioned on the opposite side in the transverse direction of the feeding beam with respect to the jaw, so that the opening of the jaw takes place by means of a projection provided in the feeding beam for turning the wheel in the opening direction. In place of wheels, the means guiding the opening of the jaws may be of some other kind, such as mere slide pieces or pins. In place of the structure described, in which the normal guideways of the feeding beam serve as guideways, the longitudinal guideways of the feeding beam can be provided separately, and they can be e.g. rails, grooves or some other guide means suited for the purpose. In place of two guides, the positively controlled operation can be achieved by means of a single guide moving in the groove. The longitudinal guideway may as well be positioned inside the feeding beam either in connection with the edge beams or web, and it is possible as such that the edge beams or web form part of the guides.

I claim:

1. A travelling centralizer arrangement in a rock drill (2), comprising a travelling centralizer (5) mounted so as to move along a feeding beam (1) in its longitudinal direction for supporting a drill rod (4), the travelling centralizer (5) comprising two jaw halves (12*a*, 12*b*) arranged to be pressed against each other in the operating position of the centralizer (5) and allowing the passage of a chuck (3) between them when turned apart from each other; and guide means (9*a*, 9*b*, 10) for pressing the jaw halves (12*a*, 12*b*) against each other, characterized in that the jaw halves (12*a*, 12*b*) are mounted in a carriage (11) movable relative to the feeding beam (1) in its longitudinal direction on both sides of the drill rod (4) in the transverse direction relative to the feeding beam (1), said jaws being pivotable relative to the carriage (11) about a pivot axis (13*a*, 13*b*) extending longitudinally of the feeding beam (1), that the guide means comprise a guide (9*a*, 9*b*) provided in each jaw half (12*a*, 12*b*) at a distance from the pivot axis (13*a*, 13), and at least one elongated guide member (10) attached to the feeding beam (1) in its longitudinal direction, the guides (9*a*, 9*b*) being supported against the guide member (10) in the operating position of the travelling centralizer (5) to keep the jaw halves (12*a*, 12*b*) pressed against each other; and that the guide member (10) is so shaped at the forward end of the feeding beam (1) that the guides (9*a*, 9*b*) are displaceable in the transverse direction of the guide member (10), allowing the jaw halves (12*a*, 12*b*) to be pivoted about the pivot axes (13*a*, 13*b*) apart from each other.

2. A travelling centralizer arrangement according to claim 1, characterized in that it comprises two elongated guide members (10) formed by the guideways of the feeding beam (1), the guides (9*a*, 9*b*) being arranged to be supported against one surface of the guideways.

3. A travelling centralizer arrangement according to claim 1, characterized in that the guide members (10) are separate guideways, the guides (9*a*, 9*b*) being arranged to be supported against one surface of the guideways.

4. A travelling centralizer arrangement according to claim 2, characterized in that each guideway is arranged to deviate from its longitudinal axis over a portion of its length (L) at the forward end of the feeding beam (1) so that the guides (9*a*, 9*b*) are displaceable in the transverse direction of the guide member (10), allowing the jaw halves (12*a*. 12*b*) to be pivoted about the pivot axes (13*a*, 13*b*) apart from each other.

5. A travelling centralizer according to claim 2, characterized in that each jaw half (12*a*, 12*b*) is arranged to be supported by means of guides (9*a*, 15*a*; 9*b*, 15*b*) against two surfaces positioned on opposite sides of the guideway (10).

6. A travelling centralizer according to claim 5, characterized in that each jaw half (12*a*, 12*b*) comprises two guides (9*a*, 15*a*; 9*b*, 15*b*).

7. A travelling centralizer arrangement according to claim 1, characterized in that the guides (9*a*, 9*b*, 15*a*, 15*b*) are rollers or the like secured to the jaw halves (12*a*, 12*b*) so as to roll along the surface of the guide member (10).

8. A travelling centralizer according to claim 1, characterized in that the jaw halves (12*a*, 12*b*) are mounted so as to be concentrically pivotable.

9. A travelling centralizer arrangement according to claim 1, characterized in that the jaw halves (12*a*, 12*b*) are identical.

* * * * *